US009016689B2

(12) United States Patent
Osaki et al.

(10) Patent No.: US 9,016,689 B2
(45) Date of Patent: Apr. 28, 2015

(54) SHEET CONVEYING DEVICE AND IMAGE FORMING APPARATUS

(71) Applicant: KYOCERA Document Solutions Inc., Osaka-shi, Osaka (JP)

(72) Inventors: Shuji Osaki, Osaka (JP); Hironori Daigo, Osaka (JP); Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 74 days.

(21) Appl. No.: 13/917,971

(22) Filed: Jun. 14, 2013

(65) Prior Publication Data

US 2013/0334759 A1 Dec. 19, 2013

(30) Foreign Application Priority Data

Jun. 15, 2012 (JP) ..... 2012-135643

(51) Int. Cl.

| | |
|---|---|
| ***B65H 5/02*** | (2006.01) |
| ***B65H 29/00*** | (2006.01) |
| ***G03G 21/16*** | (2006.01) |
| ***G03G 15/00*** | (2006.01) |

(52) U.S. Cl.

CPC ..... *B65H 29/00* (2013.01); *G03G 21/1638* (2013.01); *G03G 2215/00544* (2013.01); *G03G 15/6552* (2013.01)

(58) Field of Classification Search

USPC ..... 271/3.14, 3.2, 272, 273

See application file for complete search history.

(56) References Cited

U.S. PATENT DOCUMENTS

| | | | | |
|---|---|---|---|---|
| 2009/0074491 | A1* | 3/2009 | Morohoshi | 399/388 |
| 2009/0226193 | A1 | 9/2009 | Muratani et al. | |
| 2009/0283962 | A1 | 11/2009 | Spence | |
| 2011/0227272 | A1 | 9/2011 | Kotera | |

FOREIGN PATENT DOCUMENTS

| | | |
|---|---|---|
| JP | 2003-54820 | 2/2003 |
| JP | 2008304551 | 12/2008 |
| JP | 2009-215070 | 9/2009 |

* cited by examiner

*Primary Examiner* — Michael McCullough
*Assistant Examiner* — Howard Sanders
(74) *Attorney, Agent, or Firm* — Gerald E. Hespos; Michael J. Porco; Matthew T. Hespos

(57) ABSTRACT

A sheet conveying device includes a housing provided with first and second side surfaces facing each other, and third and fourth side surfaces substantially orthogonal to the first and second side surfaces and facing each other. An entrance port is formed in the first side surface, an exit port is formed in the second side surface, and a sheet conveying path is formed in the housing. The housing includes first and second guide members constituting the sheet conveying path. The first and second guide members are connected to be pivotally movable relative to each other on the side of the third side surface. A gap portion is formed between the first and second guide members in a region from the connection portion on the side of the third side surface to the first side surface.

8 Claims, 13 Drawing Sheets

SHEET CONVEYING DEVICE AND IMAGE FORMING APPARATUS

This application relates to and claims priority from Japanese Patent Application No. 2012-135643, filed in the Japan Patent Office on Jun. 15, 2012, the entire disclosure of which is incorporated herein by reference.

BACKGROUND

The present disclosure relates to a sheet conveying device for conveying sheets, and an image forming apparatus having the sheet conveying device incorporated in an internal sheet discharge space.

There is known an internal exit tray type image forming apparatus configured such that a space is formed in an apparatus body for discharging sheets after image formation. Such an image forming apparatus has the advantages that the space occupation ratio is made small and the installation space is made small, because a sheet tray or a like member does not project from the apparatus body. On the other hand, a post processing device for performing a post process such as a punching process or a stapling process on sheets may be optionally mounted to such an internal exit tray type image forming apparatus afterwards. Generally, a sheet discharge port is opened toward the internal sheet discharge space, and the internal sheet discharge space is relatively small. Therefore, it is difficult to mount the post processing device in such a space afterwards.

In view of the above, in the case where a post processing device is mounted afterwards, the post processing device is mounted to a side wall of the apparatus body, i.e., a side wall opposite to the side wall of the apparatus body where a sheet discharge port is formed, and a relay unit (sheet conveying device) having a function of conveying sheets is mounted in the internal sheet discharge space. The sheets are conveyed from the sheet discharge port to the post processing device via the relay unit.

As well as in the other sheet conveying paths, a sheet jam may occur in the relay unit. The relay unit may be configured to be easily mounted and dismounted to and from the apparatus body. In the above configuration, in the case where a sheet jam has occurred, the user may inadvertently draw the relay unit from the apparatus body. In the case where a sheet is jammed between the sheet discharge port of the apparatus body and the relay unit, the sheet may be torn when the user dismounts the relay unit. There is proposed an image forming apparatus provided with a sensor for detecting whether a sheet is stuck between the relay unit and the apparatus body in order to prevent such a drawback. In such an image forming apparatus, when the sensor detects a sheet stuck, alert information is generated to alert the user.

However, even if the information indicating a sheet stuck is issued, the user may be unaware of the information, and may draw the relay unit from the apparatus body. In such a case, the jammed sheet may be torn. Thus, the performance of removing a jammed sheet is poor.

An object of the present disclosure is to provide a sheet conveying device having an enhanced performance of removing a jammed sheet, and an image forming apparatus incorporated with the sheet conveying device.

SUMMARY

A sheet conveying device according to an aspect of the present disclosure is provided with a housing, an entrance port, an exit port, and a sheet conveying path. The housing is provided with a first side surface and a second side surface facing each other, and a third side surface and a fourth side surface substantially orthogonal to the first side surface and the second side surface and facing each other. The entrance port is formed in the first side surface for receiving a sheet into the housing. The exit port is formed in the second side surface for discharging the sheet out of the housing. The sheet conveying path is formed in the housing for conveying the sheet from the entrance port to the exit port. The housing includes a first guide member, a second guide member, and a connection portion.

The first guide member has a first guide surface constituting one guide surface of the sheet conveying path. The second guide member has a second guide surface constituting another guide surface of the sheet conveying path. The second guide surface faces the first guide surface with a predetermined distance away from the first guide surface. The connection portion connects the first guide member and the second guide member to be pivotally movable relative to each other on the side of the third side surface. A gap portion is formed between the first guide member and the second guide member in a region from the connection portion on the side of the third side surface to the first side surface.

An image forming apparatus according to another aspect of the present disclosure includes an apparatus body which performs an image forming process on a sheet, an internal sheet discharge portion, a sheet discharge port, a sheet receiving device, and a sheet conveying device. The internal sheet discharge portion is formed in the apparatus body, as an internal space having an opening opened to the outside. The internal sheet discharge portion is configured to accommodate the sheet after the image forming process. The sheet discharge port is formed in the apparatus body for discharging the sheet into the internal sheet discharge portion. The sheet discharge port faces the internal space. The sheet receiving device is mounted on the apparatus body and is configured to receive the sheet. The sheet conveying device is dismountably mounted in the internal sheet discharge portion for receiving the sheet into an entrance port through the sheet discharge port, and for feeding the sheet into the sheet receiving port through an exit port. The sheet conveying device has the aforementioned configuration.

These and other objects, features and advantages of the present disclosure will become more apparent upon reading the following detailed description along with the accompanying drawings.

DETAILED DESCRIPTION

Figure 1:
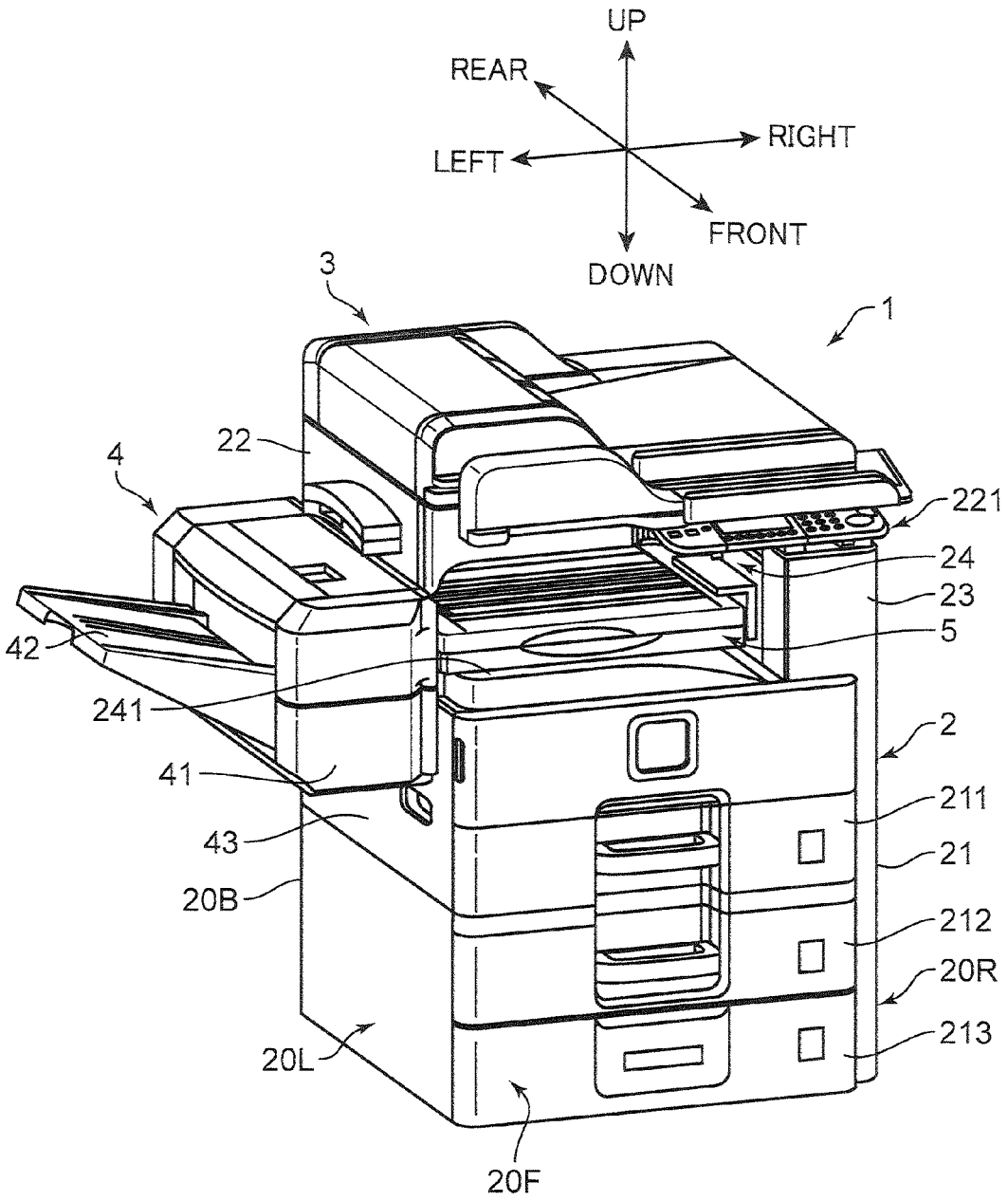
FIG. 1 is a perspective view showing an external appearance of an image forming apparatus embodying the present disclosure.
Figure 2:
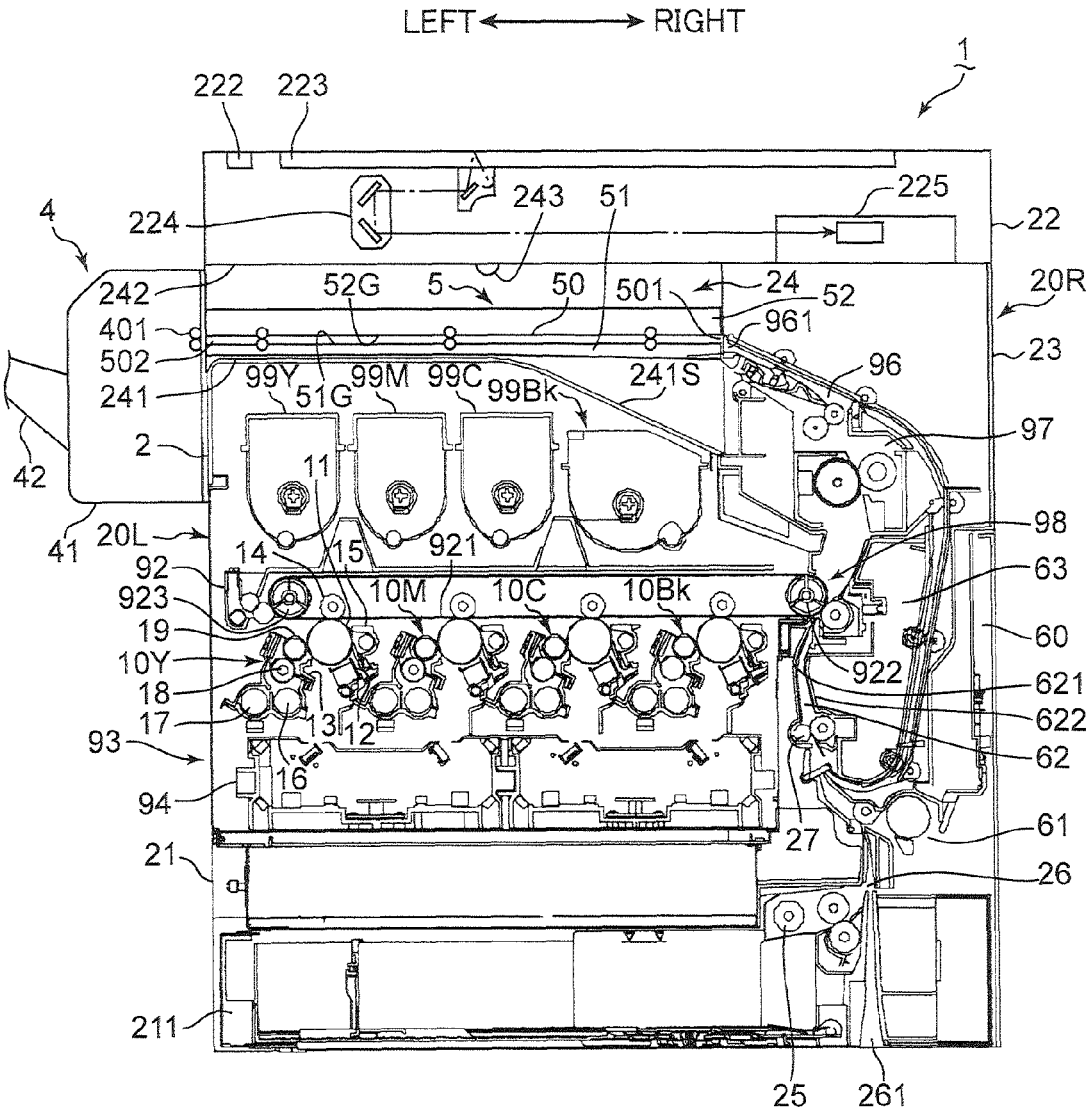
FIG. 2 is a cross sectional view showing an internal structure of the image forming apparatus.

In the following, an embodiment of the present disclosure is described in detail referring to the drawings. FIG. 1 is a perspective view showing an external appearance of an image forming apparatus 1 embodying the present disclosure. FIG. 2 is a cross sectional view showing an internal structure of the image forming apparatus 1. In the specification, the image forming apparatus 1 is an internal exit tray type copying machine. As far as the image forming apparatus has an internal sheet discharge portion, however, the image forming apparatus may be a printer, a facsimile machine, or a complex machine having the functions of these machines.

The image forming apparatus 1 is provided with an apparatus body 2 having a substantially rectangular parallelepiped housing structure with an internal space (internal sheet discharge portion 24), an automatic document feeder 3 disposed above the apparatus body 2, a post processing device 4 (sheet receiving device) disposed on a side surface of the apparatus body 2, and a relay unit 5 (sheet conveying device) drawably mounted in the internal space. The apparatus body 2 performs an image forming process on a sheet. The automatic document feeder 3 is mounted on the apparatus body 2 to provide the apparatus body 2 with a function of automatically reading a document. The post processing device 4 performs a predetermined post process to the sheet after image formation. The relay unit 5 conveys the sheet after image formation from the apparatus body 2 to the post processing device 4.

The apparatus body 2 includes a substantially rectangular parallelepiped lower housing portion 21, a substantially rectangular parallelepiped upper housing portion 22 disposed above the lower housing portion 21, and a connection housing portion 23 for connecting between the lower housing portion 21 and the upper housing portion 22. Various devices for image formation are housed in the lower housing portion 21, and various devices for optically reading a document are housed in the upper housing portion 22. An internal space surrounded by the lower housing portion 21, the upper housing portion 22, and the connection housing portion 23 is defined as the internal sheet discharge portion 24 into which a sheet after image formation is discharged. The connection housing portion 23 is disposed on the side of a right surface 20R of the apparatus body 2, and a sheet discharge port 961 through which a sheet is discharged into the internal sheet discharge portion 24 is formed in the connection housing portion 23.

The internal space serving as the internal sheet discharge portion 24 has an opening opened to the outside in each of a front surface 20F and a left surface 20L of the apparatus body 2. The user is allowed to insert his/her hand through one of the openings for taking out a sheet after image formation from the internal sheet discharge portion 24 in a state that the post processing device 4 and the relay unit 5 are not mounted on the apparatus body 2. A bottom surface 241 of the internal space is defined by an upper surface of the lower housing portion 21, and a top surface 242 of the internal space is defined by a lower surface of the upper housing portion 22. The bottom surface 241 has an inclined surface 241S inclining downwardly toward the connection housing portion 23 for aligning the discharged sheets on the trailing ends thereof in a sheet conveying direction.

An illumination lamp 243 (illuminating member) for illuminating the space of the internal sheet discharge portion 24, which appears dark because the internal sheet discharge portion is formed on the inner side of the apparatus body 2, is mounted on the top surface 242. The illumination lamp 243 is controlled to be turned on and off by an unillustrated controller. In a state that the relay unit 5 is not mounted, the illumination lamp 243 illuminates a sheet to be discharged into the internal sheet discharge portion 24 for making it easy for the user to recognize the discharged sheet. On the other hand, in a state that the relay unit 5 is mounted, the illumination lamp 243 illuminates the relay unit 5 configured such that a part of the relay unit 5 is formed of a transparent member to be described later. This contributes to enhanced workability in removing a jammed sheet, for instance.

An operation portion 221 is provided so as to protrude from a front surface of the upper housing portion 22. The operation portion 221 includes an LCD touch panel, a numeric keypad, and a start key. The operation portion 221 receives an input indicating various operations/instructions from the user. The user is allowed to input the number of sheets to be printed, a printing density, and the like by way of the operation portion 221.

Three sheet cassettes 211, 212, and 213 for accommodating sheets for an image forming process are installed in the lower housing portion 21. The user is allowed to draw out the sheet cassettes 211, 212, and 213 in forward direction from the front surface 20F of the lower housing portion 21 (apparatus body 2). In FIG. 2, only the uppermost sheet cassette 211 is shown. The sheet cassettes 211, 212, and 213 are the cassettes provided for automatic sheet feeding. A sheet feeding tray 60 for manual sheet feeding is provided on the right surface 20R of the apparatus body 2 (see FIG. 2). The sheet feeding tray 60 is mounted on the lower housing portion 21 to be pivotally opened and closed around a lower end of the sheet feeding tray 60. In the case where manual sheet feeding is performed, the user opens the sheet feeding tray 60, and places a sheet or sheets on the sheet feeding tray 60.

The automatic document feeder 3 is mounted on the upper surface of the apparatus body 2 to be pivotally movable on the side of a back surface 20B of the apparatus body 2. In FIG. 2, the illustration of the automatic document feeder 3 is omitted. The automatic document feeder 3 automatically feeds a document or documents to be copied toward a predetermined document reading position of the apparatus body 2, i.e., a position where a first contact glass 222 is disposed. On the other hand, in the case where the user manually places a document on a predetermined document reading position, i.e., a position where a second contact glass 223 is disposed, the automatic document feeder 3 is opened upwardly.

The post processing device 4 is an optional unit which is mounted on the apparatus body 2 afterwards, and is a device which performs a post process such as a punching process or a stapling process on the sheets after image formation, and discharges the sheets which have undergone the post process. The post processing device 4 is mounted on the left surface 20L of the apparatus body 2 at a position facing the left-side opening of the internal sheet discharge portion 24 via an attachment plate 43. The post processing device 4 includes a sheet receiving port 401 (see FIG. 2) which faces the internal sheet discharge portion 24 and receives sheets, a body portion 41 which houses a mechanism portion for performing a post process, and a sheet discharge tray 42 on which sheets after a process are discharged. Not only the sheets which have undergone a post process in the body portion 41, but also the sheets which pass through the body portion 41 without being subjected to a post process are discharged onto the sheet discharge tray 42.

Next, an internal structure of the apparatus body 2 is described. Toner containers 99Y, 99M, 99C, 99Bk, an intermediate transfer unit 92, an image forming assembly 93, an exposure unit 94, and the aforementioned sheet cassette 211 are housed in the lower housing portion 21 in this order from the upper side.

The image forming assembly 93 is provided with four image forming units 10Y, 10M, 10C, and 10Bk for forming the respective toner images of yellow (Y), magenta (M), cyan (C), and black (bk) so as to form a full-color toner image. Each of the image forming units 10Y, 10M, 10C, and 10Bk is provided with a photosensitive drum 11, and further includes a charger 12, a developing device 13, a primary transfer roller 14, and a cleaning device 15 disposed around the photosensitive drum 11.

The photosensitive drum 11 rotates about an axis thereof, and forms an electrostatic latent image and a toner image on the circumferential surface thereof. An example of the photosensitive drum 11 is a photosensitive drum made of an amorphous silicon (a-Si) based material. The charger 12 uniformly charges the circumferential surface of the photosensitive drum 11. The circumferential surface of the photosensitive drum 11 after a charging operation is exposed to light by the exposure unit 94 to be described later for forming an electrostatic latent image.

The developing device 13 supplies toner to the circumferential surface of the photosensitive drum 11 for developing an electrostatic latent image formed on the photosensitive drum 11. A two-component developer is used in the developing device 13. The developing device 13 includes agitation rollers 16, 17, a magnetic roller 18, and a developing roller 19. The agitation rollers 16 and 17 circulatingly feed the two-component developer while agitating the two-component developer to thereby charge the toner. A layer of the two-component developer is formed on the circumferential surface of the magnetic roller 18, and a toner layer obtained by transferring toner by a potential difference between the magnetic roller 18 and the developing roller 19 is formed on the circumferential surface of the developing roller 19. The toner on the developing roller 19 is supplied to the circumferential surface of the photosensitive drum 11, whereby the electrostatic latent image is developed.

The primary transfer roller 14 forms a nip portion with the photosensitive drum 11 in a state that an intermediate transfer belt 921 provided in the intermediate transfer unit 92 is interposed between the primary transfer roller 14 and the photosensitive drum 11, and transfers the toner image to the intermediate transfer belt 921. The cleaning device 15 cleans the circumferential surface of the photosensitive drum 11 after the toner image transfer.

The yellow toner container 99Y, the magenta toner container 99M, the cyan toner container 99C, and the black toner container 99Bk respectively store toners of the respective colors, and supply the toners of the respective colors to the developing devices 13 in the image forming units 10Y, 10M, 10C, and 10Bk corresponding to the respective colors of Y, M, C, and Bk via an unillustrated toner feeding path.

The exposure unit 94 has various optical devices such as a laser light source, a polygon mirror, a reflecting mirror, and a deflecting mirror. The exposure unit 94 irradiates laser light modulated based on image data of a document image onto the circumferential surface of the photosensitive drum 11, which is provided in each of the image forming units 10Y, 10M, 10C, and 10Bk, for forming electrostatic latent images.

The intermediate transfer unit 92 is provided with the intermediate transfer belt 921, a drive roller 922, and a driven roller 923. Toner images are transferred one over the other from the photosensitive drums 11 onto the intermediate transfer belt 921 (primary transfer). The superimposed toner images are then transferred onto a sheet, which is supplied from the sheet cassette 211 or from the sheet feeding tray 60, by secondary transfer in a secondary transfer portion 98. The drive roller 922 and the driven roller 923 for driving and circulating the intermediate transfer belt 921 are rotatably supported on the lower housing portion 21.

A sheet stack obtained by stacking sheets is accommodated in the sheet cassette 211. A pickup roller 25 is disposed above a right end of the sheet cassette 211. An uppermost sheet of the sheet stack in the sheet cassette 211 is dispensed one by one by driving the pickup roller 25, and is conveyed to an entrance conveying path 26. The entrance conveying path 26 joins a joint conveying path 261 extending from a lower position of the apparatus body 2. A sheet dispensed from the lower sheet cassette 212, 213 (see FIG. 1) is conveyed to the entrance conveying path 26 via the joint conveying path 261. On the other hand, a sheet placed on the sheet feeding tray 60 is conveyed to the entrance conveying path 26 by driving a sheet feeding roller 61.

A sheet conveying path 62 is formed on the downstream side of the entrance conveying path 26. The sheet conveying path 62 extends to the sheet discharge port 961 via the secondary transfer portion 98, a fixing unit 97, and a sheet discharge unit 96 to be described later. An upstream portion of the sheet conveying path 62 is formed between an inner wall 621 constituting a part of the lower housing portion 21, and an inner wall 622 constituting an inner surface of a switchback conveying unit 63. A registration roller pair 27 is disposed on the upstream side of the sheet conveying path 62 than the secondary transfer portion 98. Conveying of a sheet is temporarily stopped by the registration roller pair 27 for skew correction. Thereafter, the sheet is fed to the secondary transfer portion 98 at a predetermined timing for image transfer.

The fixing unit 97 and the sheet discharge unit 96 are provided in the connection housing portion 23. The fixing unit 97 includes a fixing roller and a pressing roller. The fixing unit 97 performs a fixing process by applying heat and pressure to a sheet carrying a toner image which has undergone secondary transfer process in the secondary transfer portion 98. The sheet carrying a color image which has undergone a fixing process is discharged into the internal sheet discharge portion 24 through the sheet discharge port 961 by the sheet discharge unit 96, which is disposed downstream of the fixing unit 97.

The first contact glass 222 and the second contact glass 223 are provided in the upper surface of the upper housing portion 22. The first contact glass 222 is provided for reading a document which is automatically fed from the automatic document feeder 3, and the second contact glass 223 is provided for reading a manually placed document. A scanning mechanism 224 and an imaging element 225 for optically reading document information are provided in the upper housing portion 22. The scanning mechanism 224 includes a light source, a travelling carriage, and a reflecting mirror. The scanning mechanism 224 guides reflected light from the document to the imaging element 225. The imaging element 225 photoelectrically converts the reflected light into an analog electrical signal. The analog electrical signal is converted into a digital electrical signal by an A/D conversion circuit (not shown), and then, the digital electrical signal is input to the exposure unit 94.

In the case where the post processing device 4 is mounted on the left surface 20L of the apparatus body 2 afterwards, the relay unit 5 is mounted in the internal sheet discharge portion 24 in such a manner as to convey a sheet horizontally while crossing the internal space (internal sheet discharge portion 24) from the sheet discharge port 961 through which the sheet is discharged from the apparatus body 2 to the sheet receiving port 401 formed in the post processing device 4. The relay unit 5 includes two guide members which are stacked in a vertical direction, specifically, a lower guide member 51 (first guide member) and an upper guide member 52 (second guide member). A relay conveying path 50 (sheet conveying path) horizontally extends between the lower guide member 51 and the upper guide member 52. After the post processing device 4 and the relay unit 5 are mounted, a sheet after image formation is allowed to pass the relay unit 5, regardless of whether the sheet will be subjected to a post process or not.

The lower guide member 51 is provided with a lower guide surface 51G (first guide surface) along which a sheet to be conveyed is guided. Likewise, the upper guide member 52 is provided with an upper guide surface 52G (second guide surface) along which the sheet to be conveyed is guided. The relay conveying path 50 is formed by disposing the lower guide surface 51G and the upper guide surface 52G to face each other with a predetermined gap. An entrance port 501 for receiving a sheet from the sheet discharge port 961 is formed in a right end (upstream end) of the relay conveying path 50, and an exit port 502 for discharging the sheet to the sheet receiving port 401 formed in the post processing device 4 is formed in a left end (downstream end) of the relay conveying path 50.

Figure 3:
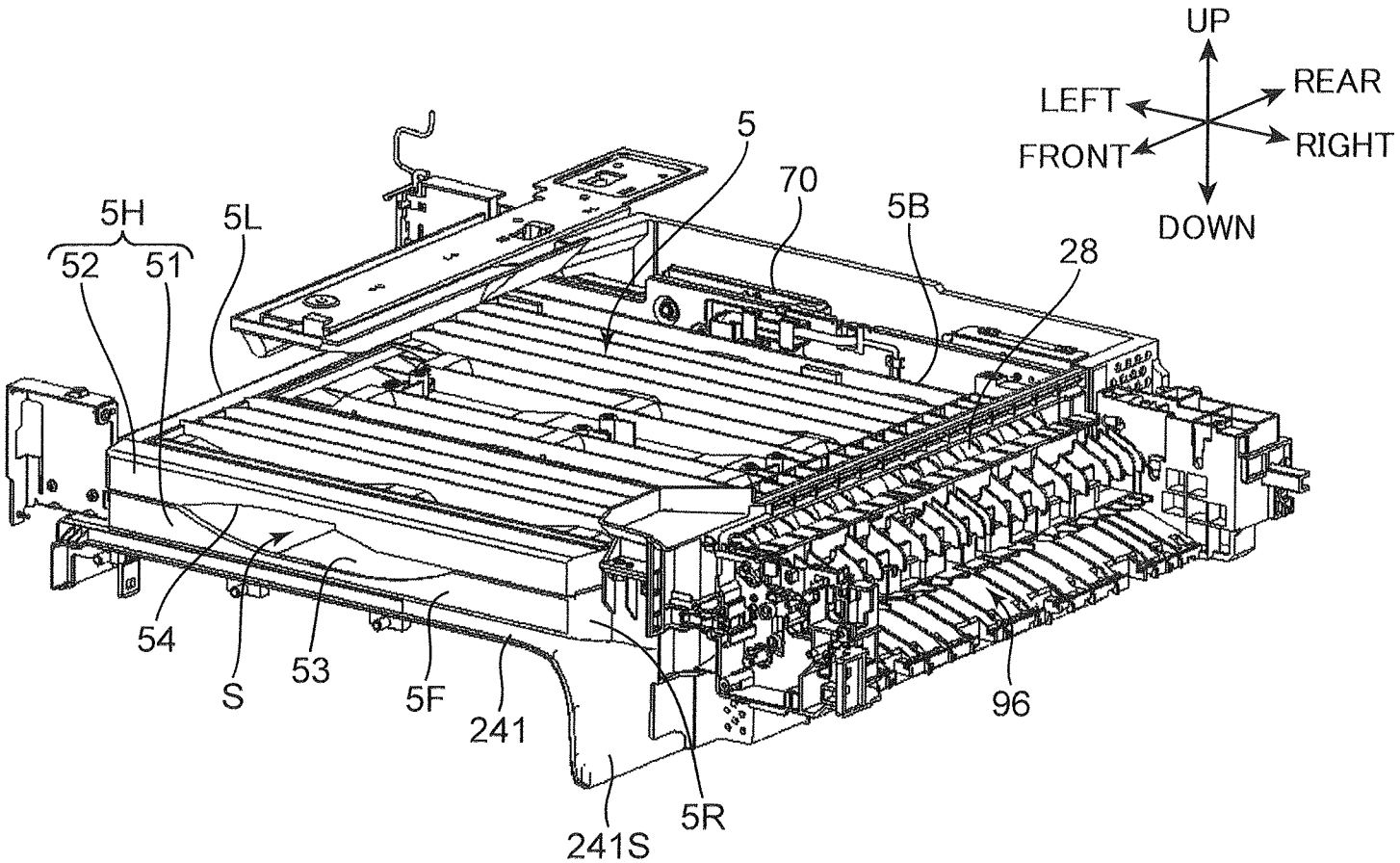
FIG. 3 is a perspective view of a relay unit (sheet conveying device) including a part of an apparatus body.
Figure 4:
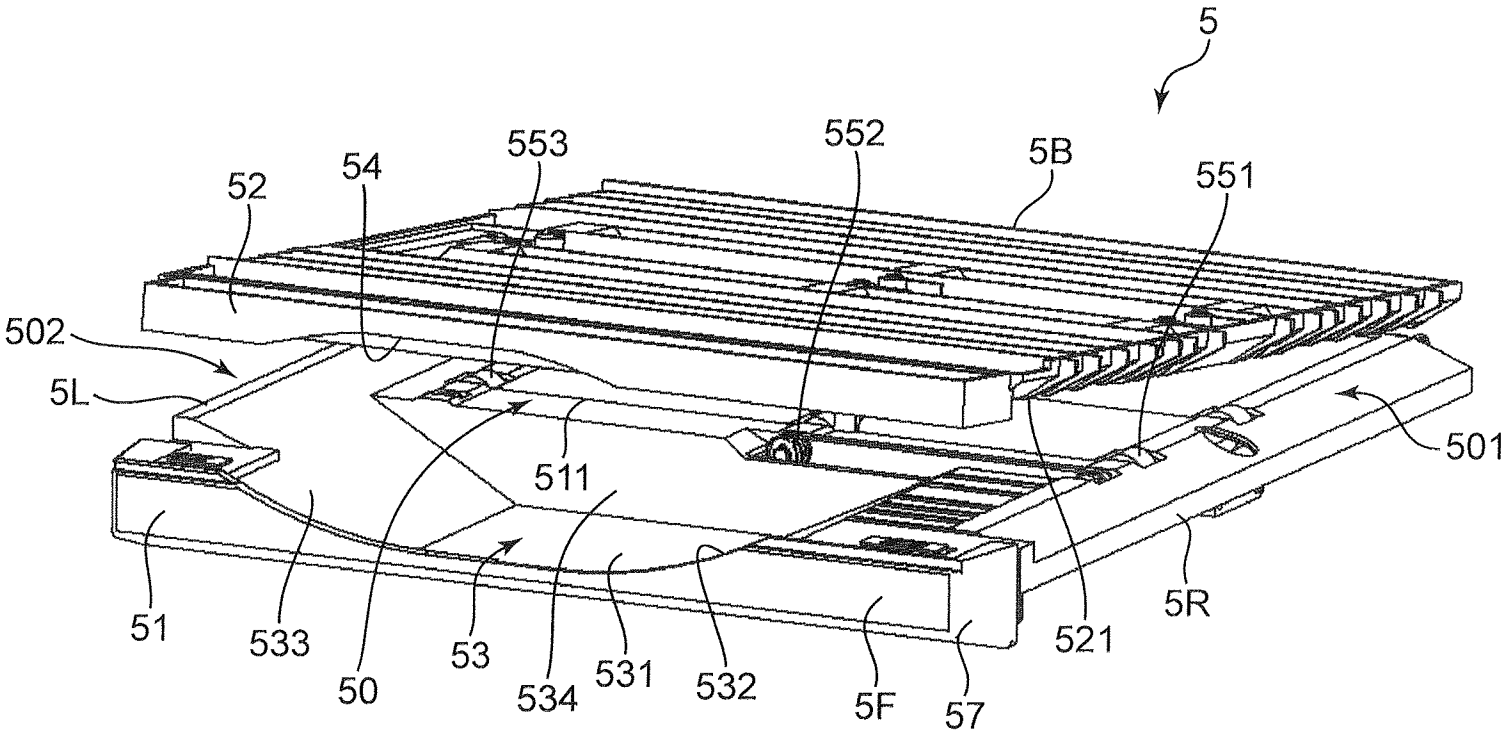
FIG. 4 is a perspective view of the relay unit in a state that an upper guide member is opened.

FIG. 3 is a perspective view of the relay unit 5 including a part of the apparatus body 2. FIG. 4 is a perspective view of the relay unit 5, and is a diagram showing a state that the upper guide member 52 is opened upwardly. The relay unit 5 includes a housing 5H having a quadrangular prismatic shape with a relatively small thickness in a vertical direction. The housing 5H is formed by combining the lower guide member 51 and the upper guide member 52. Each of the lower guide member 51 and the upper guide member 52 is a molded product made of a hard resin. In this embodiment, the upper guide member 52 is formed of a transparent resin member. Accordingly, the user can visually see the relay conveying path 50 in the housing 5H by turning on the illumination lamp 243. The lower guide member 51 is formed of a non-transparent resin member. In a modification, however, the lower guide member 51 may also be formed of a transparent resin member.

The housing 5H is provided with a right surface 5R (first side surface) and a left surface 5L (second side surface) facing each other, and a front surface 5F (fourth side surface) and a back surface 5B (third side surface) substantially orthogonal to the right surface 5R and the left surface 5L, substantially orthogonal to the direction of drawing the relay unit 5 from the internal sheet discharge portion 24, and facing each other. The entrance port 501 through which a sheet is guided into the housing 5H is formed in the right surface 5R, and the exit port 502 through which the sheet is fed out of the housing 5H is formed in the left surface 5L. The relay conveying path 50 is a conveying path along which a sheet guided in through the entrance port 501 is conveyed to the exit port 502.

In a state that the relay unit 5 is mounted in the internal sheet discharge portion 24, the lower surface of the housing 5H is contacted with the bottom surface 241 of the internal sheet discharge portion 24, and the right surface 5R of the housing 5H adjoins the connection housing portion 23. Referring to FIG. 3, the sheet discharge unit 96 and a decurler device 28 (not shown in FIG. 2) for correcting curl of a sheet are disposed in the connection housing portion 23 while adjoining the right surface 5R of the relay unit 5. Further, the back surface 5B of the housing 5H adjoins an opposing wall 70 on which a drive motor (not shown) disposed on the back surface 20B of the apparatus body 2 is mounted. On the other hand, the front surface 5F is located near the opening in the internal sheet discharge portion 24 on the front surface 20F side of the apparatus body 2.

As shown in FIG. 4, the lower guide member 51 has a number of ribs 511 which stand upright from a base block of a flat plate shape, and extend in the sheet conveying direction. The upper guide member 52 has a number of ribs 521 extending in the sheet conveying direction, and a connection plate (not shown in FIG. 4) which connects the ribs 521 in a state that the ribs 521 are aligned in front and rear directions. The lower guide surface 51G and the upper guide surface 52G shown in FIG. 2 are respectively formed of protruding upper ends of the ribs 511, and protruding lower ends of the ribs 521.

The lower guide member 51 has a recess portion 53 formed by indenting a part of the lower guide surface 51G downwardly. The recess portion 53 has an end edge portion on the side of the front surface 5F, and extends in the direction toward the back surface 5B (depthwise direction of the internal space). The recess portion 53 is an indent formed near the middle part of the front surface 5F in the sheet conveying direction, and has a moderate arc shape in section. The recess portion 53 is defined by a generally flat bottom surface 531, a right inclined surface 532 extending from a right edge of the bottom surface 531 obliquely upwardly and rightwardly, a left inclined surface 533 extending from a left edge of the bottom surface 531 obliquely upwardly and leftwardly, and a rear wall 534 rising sharply from a rear edge of the bottom surface 531.

The front surface 5F of the upper guide member 52 is provided with a cutaway portion 54 bulging upwardly with a moderately curved surface. The cutaway portion 54 faces the recess portion 53 in a state that the upper guide member 52 is closed with respect to the lower guide member 51. Accordingly, as shown in FIG. 3, there is formed an opening S in the front surface 5F of the housing 5H of such a size that the user can insert his/her hand in a state that the upper guide member 52 is closed.

The lower guide member 51 has three transport rollers i.e. a first transport roller 551, a second transport roller 552, and a third transport roller 553 which exerts a conveying force on a sheet passing the relay conveying path 50. The transport rollers 551, 552, and 553 are aligned in left and right directions with a substantially equal interval. The transport rollers 551, 552, 553 are applied with a rotating force from the unillustrated drive motor disposed on the opposing wall 70 for conveying a sheet by the rotating force. The upper guide member 52 has driven rollers (not shown) which form a transport nip with the transport rollers 551, 552, and 553 at positions respectively facing the transport rollers 551, 552 and 553.

Figure 5:
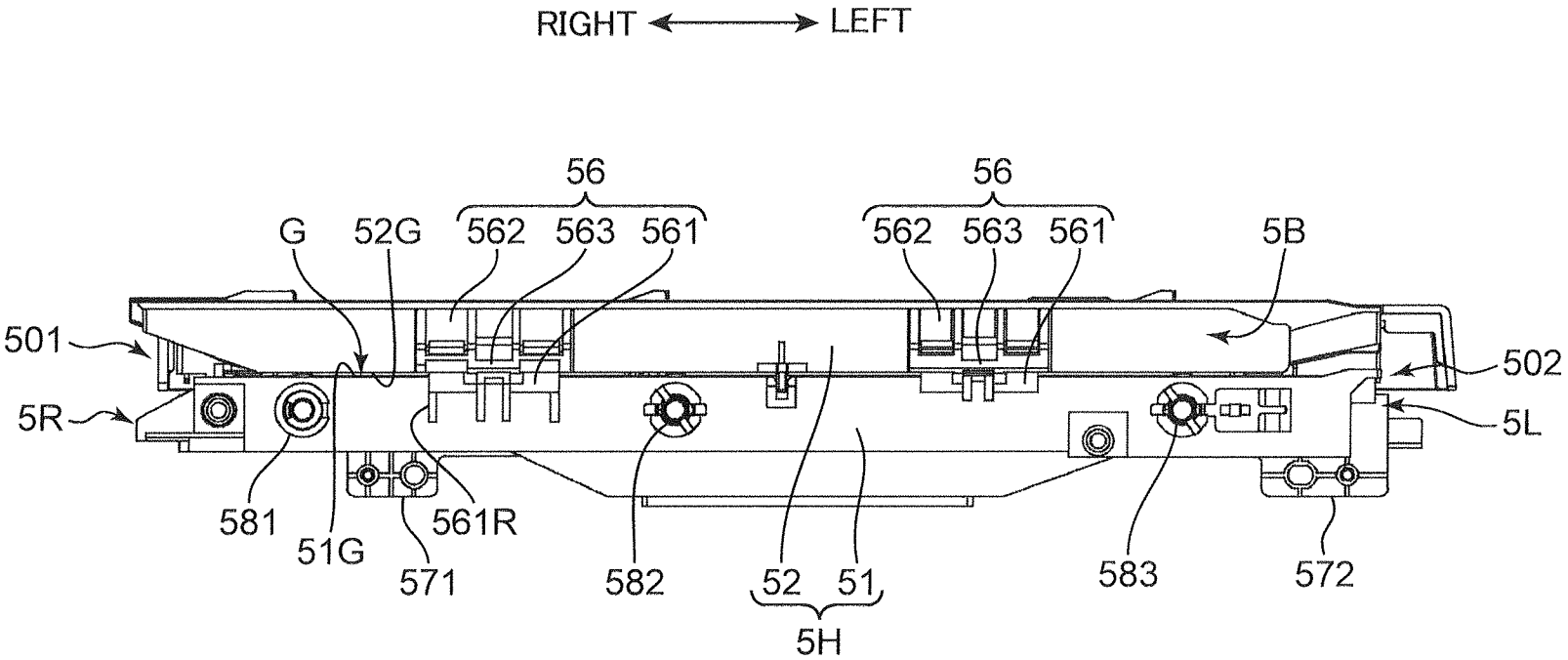
FIG. 5 is a rear view of the relay unit.
Figure 6:
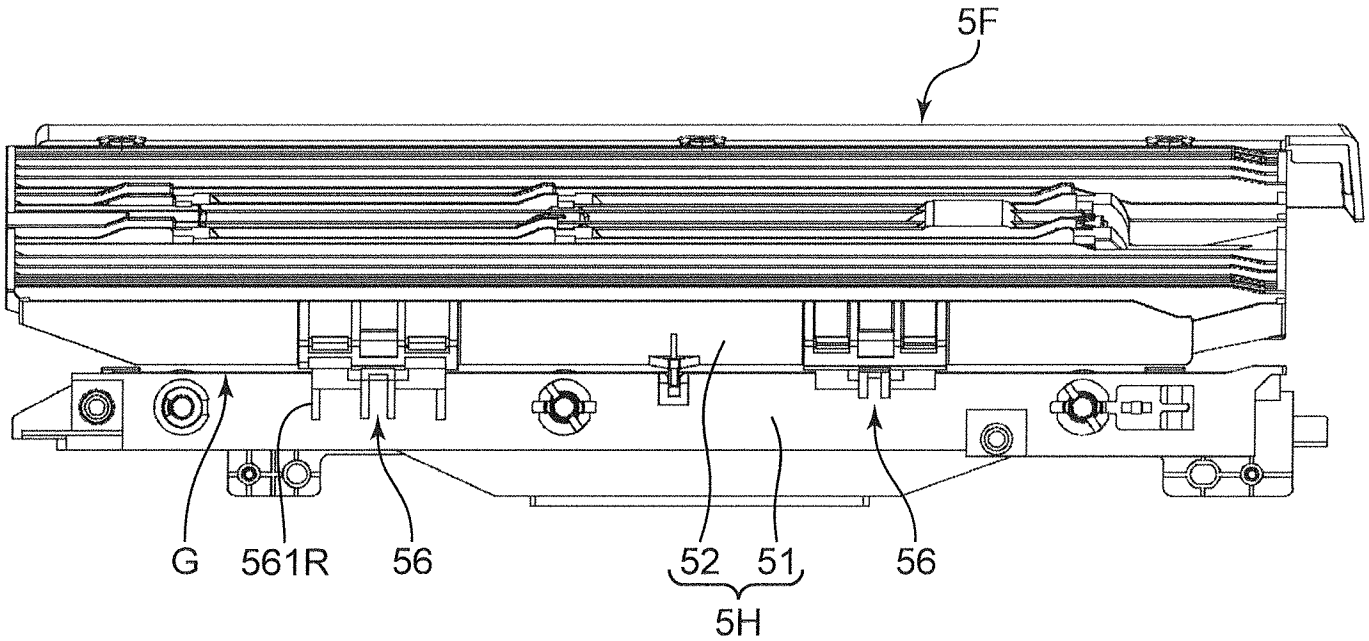
FIG. 6 is a rear view of the relay unit, and is a diagram showing a state that the upper guide member is opened.

FIG. 5 is a rear view of the relay unit 5. FIG. 6 is a rear view of the relay unit 5, and is a diagram showing a state that the upper guide member 52 is opened upwardly. The lower guide member 51 and the upper guide member 52 are hinge-connected to each other on the back surface 5B side. Specifically, the housing 5H includes hinge connection portions 56 (connection portion) for pivotally connecting the lower guide member 51 and the upper guide member 52 on the side of the back surface 5B. In this embodiment, there are provided two hinge connection portions 56 spaced away from each other in left and right directions. Each of the hinge connection portions 56 is constituted of a first hinge piece 561 provided on the lower guide member 51, a second hinge piece 562 provided on the upper guide member 52, and an engaging portion 563 for engaging the first hinge piece 561 and the second hinge piece 562 to be pivotally move the lower guide member 51 and the upper guide member 52 relative to each other. In this way, the upper guide member 52 is pivotally movable relative to the lower guide member 51 around a rear end of the upper guide member 52.

When the front surface 5F side of the upper guide member 52 is lifted upwardly, the relay conveying path 50 is opened to the outside. In a state that the relay unit 5 is mounted in the internal sheet discharge portion 24, as the upper guide member 52 is opened upwardly to some extent, the upper surface of the upper guide member interferes with the top surface 242 of the internal space. Accordingly, the upper guide member 52 is allowed to open upwardly in the range of angle until the upper guide member 52 interferes with the top surface 242. The relay conveying path 50 is opened to the outside only after the opening angle of the upper guide member 52 exceeds the limit. Accordingly, even if a sheet jam has occurred in the relay conveying path 50, the user can easily expose the jammed sheet by opening the relay conveying path 50. This makes it easy for the user to remove the jammed sheet.

Figure 9:
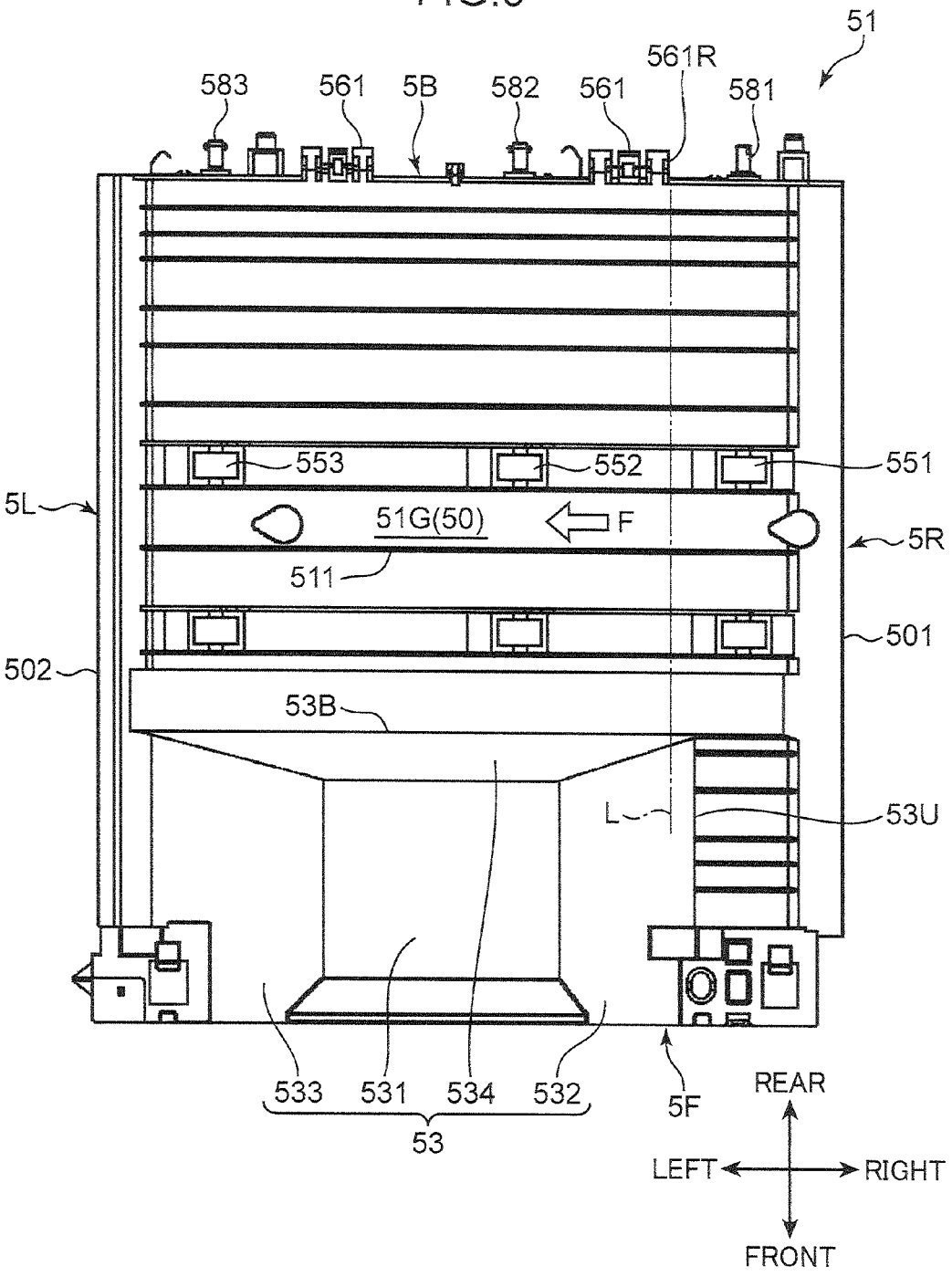
FIG. 9 is a top plan view of a lower guide member.

Referring additionally to FIG. 9, which is a top plan view of the lower guide member 51, the back surface 5B of the lower guide member 51 has a first drive input portion 581, a second drive input portion 582, and a third drive input portion 583 projecting from the back surface 5B. The first drive input portion 581, the second drive input portion 582, and the third drive input portion 583 are respectively coupled to rear ends of driving shafts of the first transport roller 551, the second transport roller 552, and the third transport roller 553. A rotational driving force is input from the drive motor to the drive input portions 581, 582, and 583 via an unillustrated coupling member disposed on the opposing wall 70.

Figure 7:
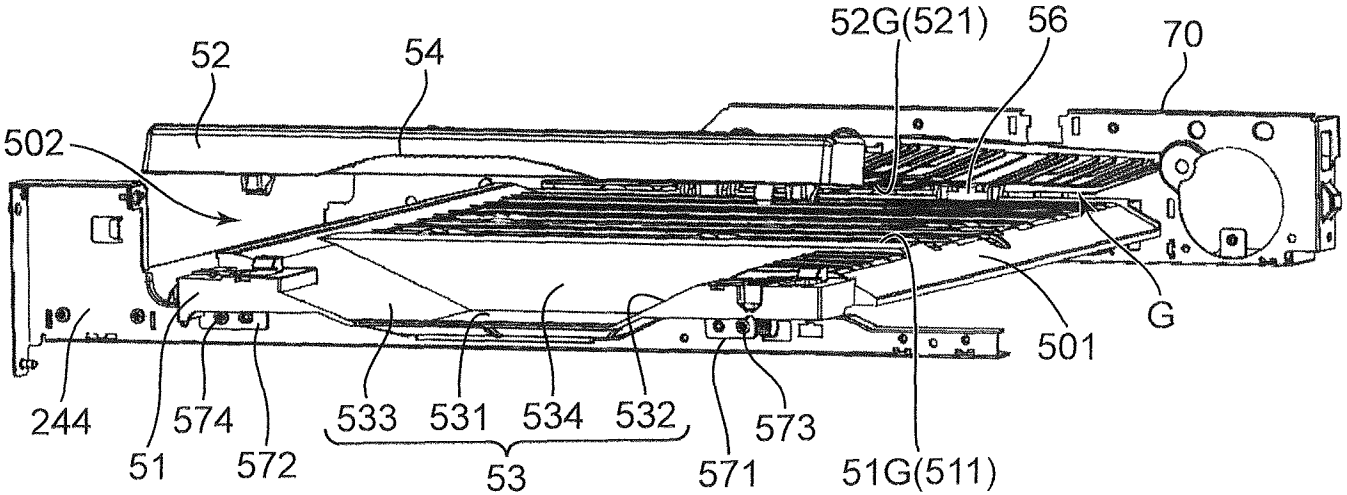
FIG. 7 is a front perspective view of the relay unit, and is a diagram showing a state that the upper guide member is opened.

FIG. 7 is a front perspective view of the relay unit 5, and is a diagram showing a state that the upper guide member 52 is opened. In FIG. 7, a cover member 57 (see FIG. 4) attached to the front surface 5F of the lower guide member 51 is detached. As shown in FIGS. 5 to 7, a pair of left and right attachment plates 571 and 572 project downwardly from the bottom surface of the lower guide member 51. Screw holes are formed in the attachment plates 571 and 572. The attachment plates 571 and 572 are fixed (provisionally fixed) to a frame 244 near the bottom surface 241 of the internal space by screws 573 and 574 (fixing member).

In mounting the relay unit 5 in the internal sheet discharge portion 24, the relay unit 5 is inserted to a predetermined position in the internal sheet discharge portion 24 in a state that the cover member 57 is detached. When the relay unit 5 has been completely inserted to the predetermined position, the drive input portions 581, 582, 583, and the coupling member on the opposing wall 70 are connected to each other, and the positions of the sheet discharge port 961 and the entrance port 501 are aligned with each other. Further, the attachment plates 571 and 572 on the relay unit 5 side, and the frame 244 on the apparatus body 2 side face each other at a predetermined position. Thereafter, the attachment plate 571 is fixed to the frame 244 by the screw 573, and the attachment plate 572 is fixed to the frame 244 by the screw 574, respectively.

Using the fastening structure by the screws 573 and 574 as described above prevents the user from inadvertently dismounting the relay unit 5 from the internal sheet discharge portion 24. This makes it possible to prevent tearing of a jammed sheet, which may occur when the user inadvertently dismounts the relay unit 5. On the other hand, in the case where it is necessary to dismount the relay unit 5 for removing a jammed sheet, the user can dismount the relay unit 5 from the internal sheet discharge portion 24 merely by detaching the cover member 57, and unfastening the screws 573 and 574. In other words, the relay unit 5 is provisionally fixed to the apparatus body 2 in the aspect that the relay unit 5 can be dismounted by a relatively simplified operation, regardless that the relay unit 5 is fixedly mounted to the apparatus body 2.

Figure 8:
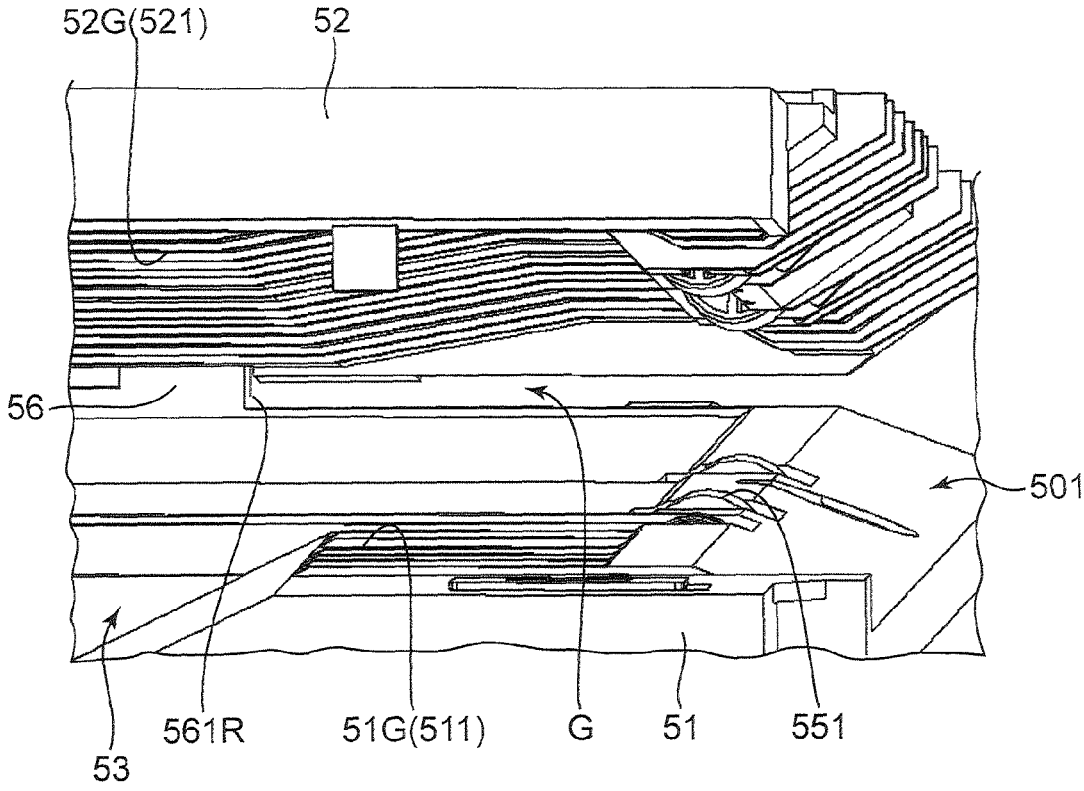
FIG. 8 is an enlarged view showing essential parts of the relay unit shown in FIG. 7.

In addition to the configuration of the relay unit 5 as described above, in this embodiment, as shown in FIGS. 5 to 8, a gap portion G is formed on the side of the back surface 5B. The gap portion G extends in left and right directions (sheet conveying direction) between the lower guide member 51 and the upper guide member 52. The vertical size of the gap portion G is substantially equal to the vertical size of the gap to be formed between the lower guide surface 51G of the lower guide member 51 and the upper guide surface 52G of the upper guide member 52 in a state that the upper guide member 52 is closed. As shown in FIGS. 6 to 8, the gap portion G is a gap which is retained, even in the case where the upper guide member 52 is opened upwardly.

The gap portion G is a gap for use in preventing tearing of a jammed sheet in dismounting the relay unit 5 from the internal sheet discharge portion 24. In this embodiment, the gap portion G is formed over the entire length of the housing 5H in left and right directions, except for the length corresponding to the two hinge connection portions 56. Alternatively, the gap portion G may be formed at least in a region from a right end wall 561R of the right-side hinge connection portion 56 (right-side first hinge piece 561) to the right surface 5R of the housing 5H. With the provision of the gap portion G as described above, it is possible to pass a sheet through the gap portion G, even in the case where the relay unit 5 is dismounted from the internal sheet discharge portion 24 in a direction orthogonal to the sheet conveying direction, with the front surface 5F facing forwardly in a state that a part of the sheet enters the housing 5H through the entrance port 501. This prevents interference of the relay unit 5 with the sheet. Accordingly, it is possible to prevent tearing of a jammed sheet.

Next, a positional relationship between the recess portion 53 and the gap portion G is described referring to FIG. 9. As described above, the recess portion 53 is a dish-shaped recess defined by the flat bottom surface 531, the right inclined surface 532 extending from the right edge of the bottom surface 531 obliquely upwardly and rightwardly, the left inclined surface 533 extending from the left edge of the bottom surface 531 obliquely upwardly and leftwardly, and the rear wall 534. In this embodiment, an end edge 53U of the recess portion 53 on the right surface 5R side (end edge on the side of the first side surface) is located on the upstream side in the sheet conveying direction (direction of the hollow arrow F shown in FIG. 9) than the right end wall 561R of the right-side first hinge piece 561 (end edge of the gap portion on the side of the first side surface), which is the end edge (end edge of the gap portion on the second side surface) of the gap portion G. FIG. 9 shows an imaginary line L extending from the position of the right end wall 561R in forward direction. Hereinafter, the imaginary line L is called a downstream end L of the gap portion G.

In this embodiment, there is shown an example, in which the end edge 53U of the recess portion 53 is located on the right side than the downstream end L of the gap portion G, and the gap portion G and the recess portion 53 partially overlap each other in the sheet conveying direction F. Alternatively, the downstream end L of the gap portion G, and the end edge 53U of the recess portion 53 may be aligned at the same position in the sheet conveying direction F. However, in an embodiment, in which the right inclined surface 532 is moderately inclined downwardly and leftwardly from the end edge 53U, as described in the embodiment, it is desirable to partially overlap the gap portion G and the recess portion 53 each other, in view of a point that it is difficult for the user to insert his/her hand near the end edge 53U.

With use of the relay unit 5, the user can insert his/her hand into the relay conveying path 50 through the recess portion 53 (opening S). If the sheet is stuck in a state that the sheet has reached the end edge 53U of the recess portion 53, the user can remove the sheet from the front surface 5F side via the recess portion 53. On the other hand, if the sheet is stuck in a state that the sheet has not reached the end edge 53U of the recess portion 53, the user can remove the sheet by sliding the relay unit 5 in forward direction and dismounting the relay unit 5 from the internal sheet discharge portion 24, although it is difficult to take out the sheet from the recess portion 53. In this case, the sheet is stuck on the upstream side than the downstream end L of the gap portion G. Accordingly, there is no likelihood that the sheet may be torn.

Figure 10:
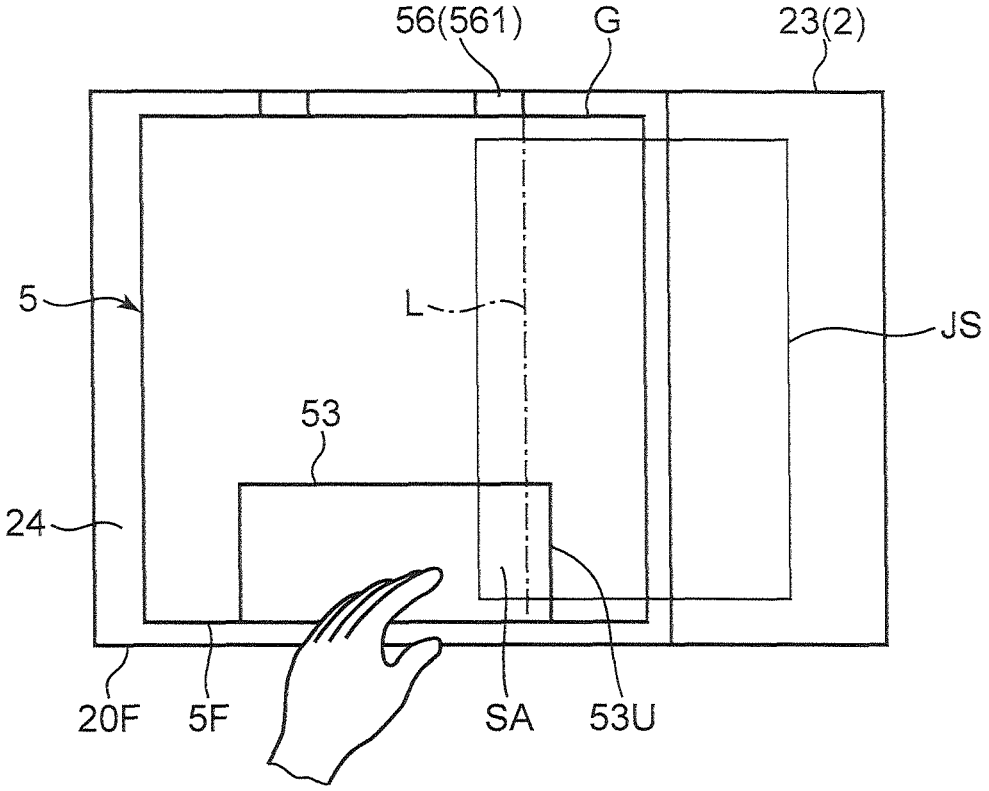
FIG. 10 is a schematic top plan view showing a state that a sheet jam has occurred, specifically, a state that a part of a sheet has entered a recess portion of the relay unit.
Figure 11:
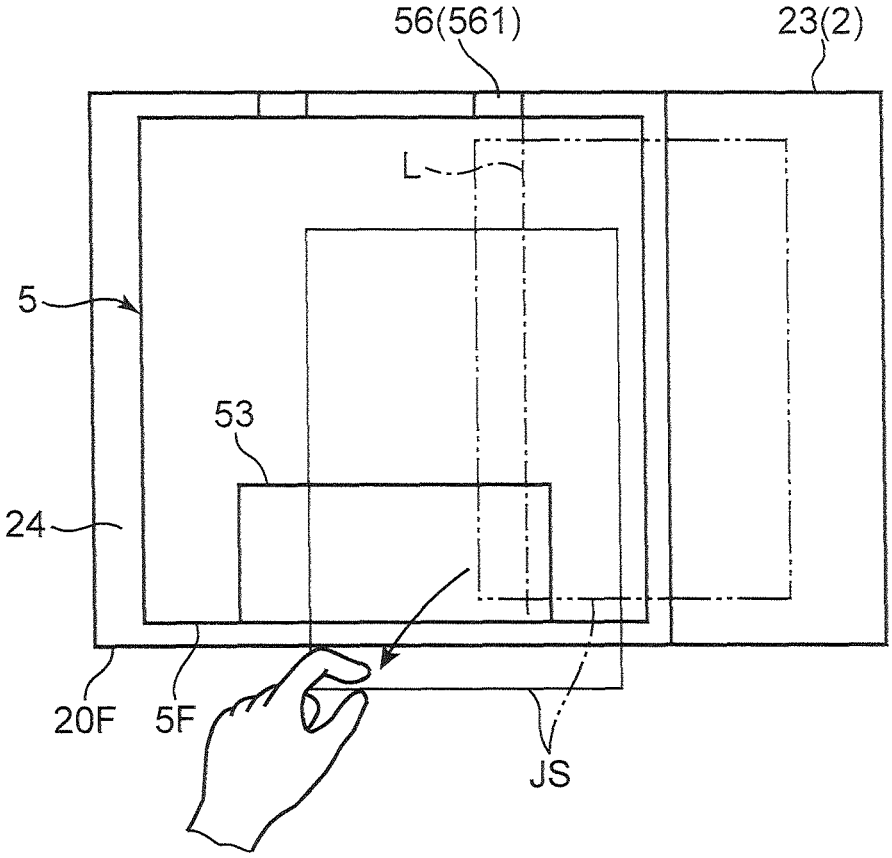
FIG. 11 is a schematic top plan view showing a state as to how the sheet jam shown in FIG. 10 is removed.

The above matter is described in detail referring to FIGS. 10 to 13. In this example, a jammed sheet JS is stuck between the connection housing portion 23 of the apparatus body 2 and the relay unit 5. FIG. 10 is a schematic top plan view showing a state that a sheet jam has occurred, specifically, a state that a part of a jammed sheet JS has entered the recess portion 53 of the relay unit 5. FIG. 11 is a schematic top plan view showing a state as to how the sheet jam shown in FIG. 10 is removed.

In the case where a sheet jam as shown in FIG. 10 has occurred, in other words, in the case where apart of a jammed sheet JS has entered the relay unit 5 to such an extent that the part of the jammed sheet JS passes over the downstream end L of the gap portion G, if the relay unit 5 is forcibly dismounted from the internal sheet discharge portion 24, the hinge connection portion 56 interferes with the jammed sheet JS regardless of the presence or absence of the gap portion G, and the jammed sheet JS may be torn. However, since the relay unit 5 is fixedly mounted to the apparatus body 2 by the screws 573 and 574, the user finds it difficult to dismount the relay unit 5 in this state. Therefore, in this occasion, the user is encouraged to remove the jammed sheet JS by inserting his/her hand into the recess portion 53.

In the example shown in FIG. 10, a leading end SA of a jammed sheet JS in the sheet conveying direction enters the recess portion 53. Accordingly, the user can touch the leading end SA of the jammed sheet JS by inserting his/her hand into the recess portion 53. When an external force to open the relay conveying path 50 is exerted by user's inserting his/her user's hand into the recess portion 53, the upper guide member 52 is pivotally moved about the axes of rotation of the hinge connection portions 56, whereby the upper guide member 52 on the front surface 5F side is lifted upwardly. By the above operation, the relay conveying path 50 is opened. Accordingly, the user can easily pick up the leading end SA of the jammed sheet JS with his/her fingers. Thereafter, as shown in FIG. 11, the user can take out the jammed sheet JS from the front surface 20F side of the apparatus body 2.

Figure 12:
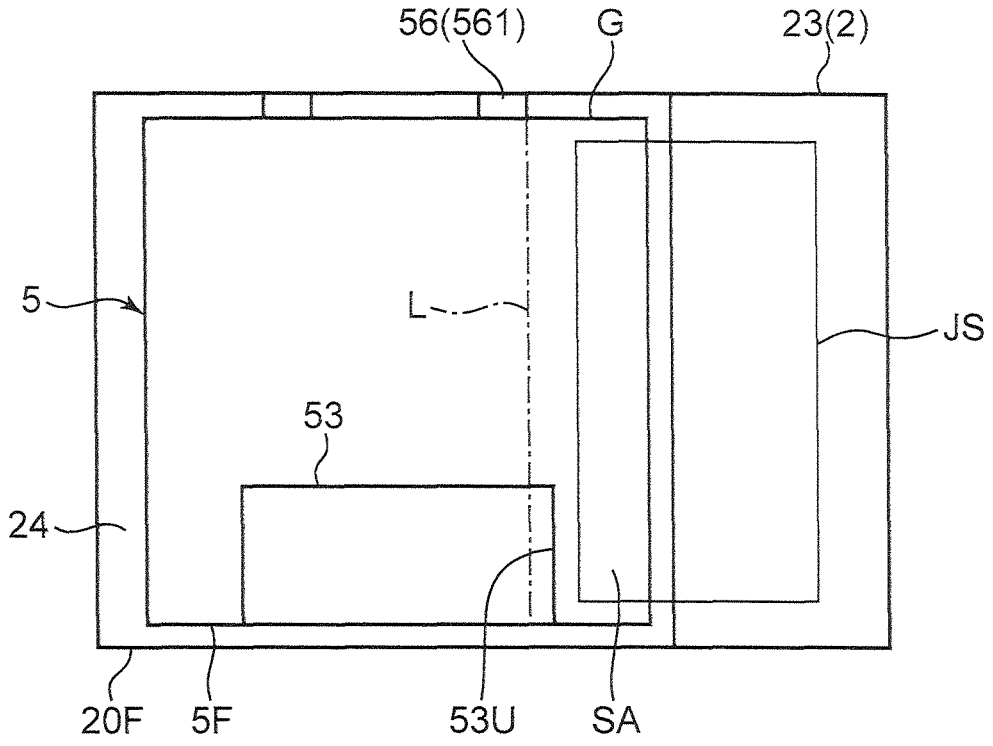
FIG. 12 is a schematic top plan view showing a state that a sheet jam has occurred, specifically, a state that a part of a sheet has reached a position immediately before the recess portion of the relay unit.
Figure 13:
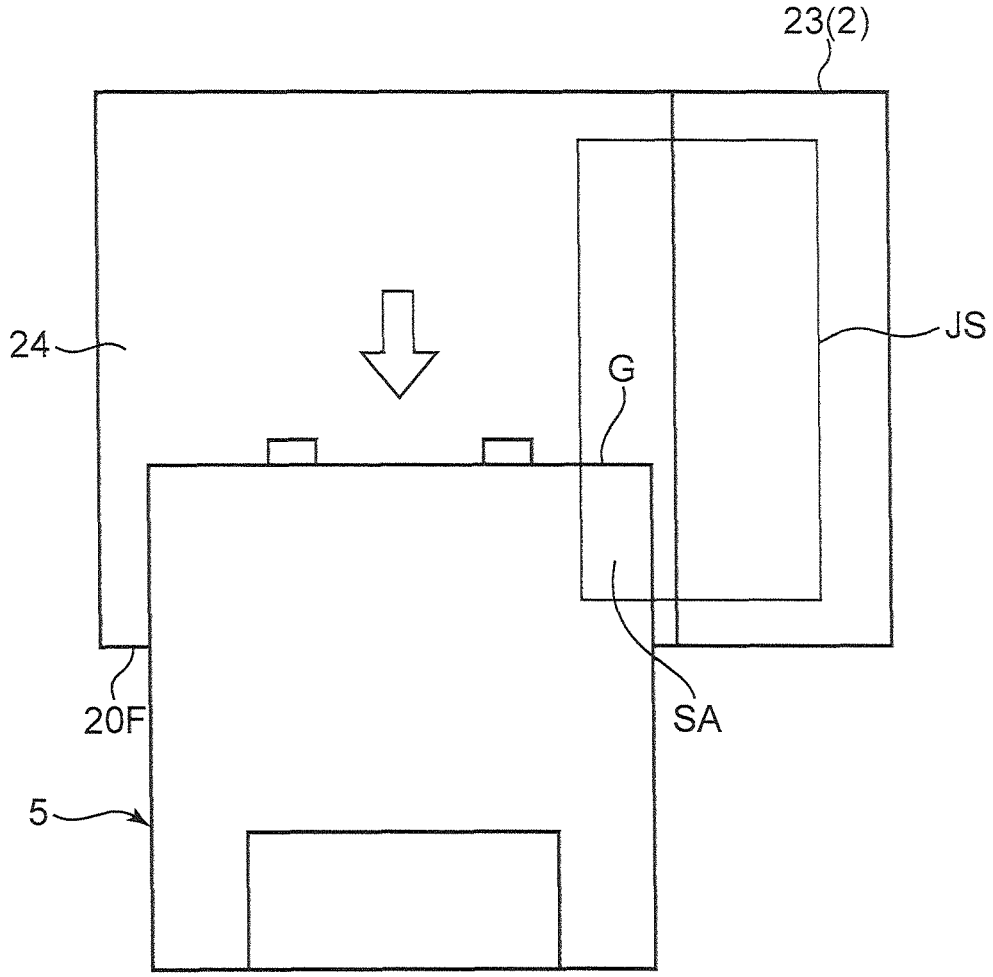
FIG. 13 is a schematic top plan view showing a state as to how the sheet jam shown in FIG. 12 is removed.

Next, another example is described. FIG. 12 is a schematic top plan view showing a state that a sheet jam has occurred, specifically, a state that a jammed sheet JS is stuck at a position immediately before the recess portion 53 of the relay unit 5. FIG. 13 is a schematic top plan view showing a state as to how the sheet jam shown in FIG. 12 is removed. In the case where a sheet jam as shown in FIG. 12 has occurred, the user finds it difficult to remove the jammed sheet JS by inserting his/her hand into the recess portion 53, because the leading end SA of the jammed sheet JS has not reached the recess portion 53. The same condition is applied to a case, in which the upper guide member 52 is fully opened until the upper guide member 52 abuts against the top surface 242.

In the case where the jammed sheet JS is stuck at the aforementioned position, however, there is no likelihood that the jammed sheet JS may be torn, even if the user dismounts the relay unit 5. Specifically, the leading end SA of the jammed sheet JS has not reached the downstream end L of the gap portion G. Accordingly, it is possible to pass the jammed sheet JS through the space of the gap portion G, even if the user draws out the relay unit 5 in forward direction.

In the above case, the user detaches the cover member 57 from the lower guide member 51, and then unfastens the screws 573 and 574. Then, as shown in FIG. 13, the user dismounts the relay unit 5 from the internal sheet discharge portion 24. At the time of dismounting, there is no likelihood that the relay unit 5 may interfere with the jammed sheet JS, because the leading end SA of the jammed sheet JS does not contact the relay unit 5, thanks to the existence of the gap portion G. When the dismounting of the relay unit 5 is completed, the user can remove the jammed sheet JS from the connection housing portion 23, utilizing the space of the internal sheet discharge portion 24.

The aforementioned is the description of the manner as to how a sheet jam between the connection housing portion 23 and the relay unit 5 is removed. The same description is also applied to a sheet jam between the relay unit 5 and the post processing device 4. As described above, the gap portion G in this embodiment is formed over the entire length of the housing 5H, except for the length corresponding to the two hinge connection portions 56. In other words, the gap portion G is also formed in a region from a left end wall of the left-side hinge connection portion 56 to the left surface 5L of the housing 5H. Further, the ridge line of the left-side end edge of the recess portion 53 is located on the left side than the left end wall of the left-side hinge connection portion 56. Accordingly, the user can remove a jammed sheet between the relay unit 5 and the post processing device 4 substantially by the same method as described above referring to FIGS. 10 to 13.

At the time of removing a jammed sheet as described above, it is desirable to turn on the illumination lamp 243 (see FIG. 2). In this embodiment, the upper guide member 52 is formed of a transparent member. Accordingly, the user can visually see the position of the jammed sheet JS through the upper guide member 52. Thus, the user can securely recognize the position of the jammed sheet JS by turning on the illumination lamp 243. In this way, the user can securely determine whether to remove a jammed sheet by inserting his/her hand into the recess portion 53 (see FIG. 11), or to dismount the relay unit 5 (see FIG. 13).

In the image forming apparatus 1 of the embodiment as described above, the relay unit 5 is provided with the gap portion G. Accordingly, in the case where a sheet jam has occurred such that a jammed sheet JS is stuck between the sheet discharge port 961 of the apparatus body 2 and the entrance port 501 of the relay unit 5, even if the relay unit 5 is dismounted from the internal sheet discharge portion 24, it is possible to prevent tearing of the jammed sheet JS. Accordingly, the above configuration enables to enhance the performance of removing a jammed sheet.

An embodiment of the present disclosure has been described as above. However, the present disclosure is not limited to the above. For instance, in the foregoing example, the relay unit 5 is fixed by the screws 573 and 574. Alternatively, the relay unit 5 may be provided with an engaging portion such as a hook, an engaged portion to engage with the engaging portion may be disposed on the apparatus body 2 side, and the relay unit 5 may be mounted on the apparatus body 2 by engagement between the engaging portion and the engaged portion.

According to the present disclosure, it is possible to enhance the performance of removing a jammed sheet in a sheet conveying device. Accordingly, the present disclosure provides a user-friendly sheet conveying device, and an image forming apparatus incorporated with the sheet conveying device.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet conveying device, comprising:

a housing with opposite first second side surfaces, and opposite third and fourth side surfaces substantially orthogonal to the first and second side surfaces;

an entrance port formed in the first side surface for receiving a sheet into the housing;

an exit port formed in the second side surface for discharging the sheet out of the housing; and a sheet conveying path formed in the housing for conveying the sheet from the entrance port to the exit port, wherein the housing includes:

a first guide member having a first guide surface constituting one guide surface of the sheet conveying path;

a second guide member having a second guide surface constituting another guide surface of the sheet conveying path, the second guide surface facing the first guide surface with a predetermined distance away from the first guide surface;

a connection portion connecting the first guide member and the second guide member to be pivotally movable relative to each other on a side of the third side surface;

a gap formed between the first guide member and the second guide member in a region from the connection portion on the side of the third side surface to the first side surface; and a recess indented into a part of the first guide surface of the first guide member and extending from the fourth side surface toward the third side surface, and an end edge of the recess on a side of the first side surface being located at a same position as an end edge of the gap on a side of the second side surface in a sheet conveying direction or on an upstream side in the sheet conveying direction.

2. The sheet conveying device according to claim 1, wherein the second guide member is allowed to pivotally move about an axis of rotation of the connection portion for opening the sheet conveying path when an external force to open the sheet conveying path is exerted by user's inserting his/her hand into the recess.

3. An image forming apparatus, comprising:

an apparatus body which performs an image forming process on a sheet;

an internal sheet discharge portion formed in the apparatus body, as an internal space having an opening opened to an outside, the internal sheet discharge portion being configured to accommodate the sheet after the image forming process;

a sheet discharge port formed in the apparatus body for discharging the sheet into the internal sheet discharge portion, the sheet discharge port facing the internal space;

a sheet receiving device mounted on the apparatus body and configured to receive the sheet; and a sheet conveying device drawably mounted in the internal sheet discharge portion for receiving the sheet into an entrance port through the sheet discharge port, and for feeding the sheet into the sheet receiving device through an exit port, the sheet conveying device including:

a housing with opposite first and second side surfaces, and opposite third and fourth side surfaces substantially orthogonal to the first and second side surfaces and substantially orthogonal to a direction of drawing the sheet conveying device;

the entrance port being formed in the first side surface for receiving the sheet into the housing;

the exit port being formed in the second side surface for discharging the sheet out of the housing; and a sheet conveying path formed in the housing for conveying the sheet from the entrance port to the exit port, wherein the housing includes:

a first guide member having a first guide surface constituting one guide surface of the sheet transport path;

a second guide member having a second guide surface constituting another guide surface of the sheet conveying path, the second guide surface facing the first guide surface and spaced from the first guide surface by a predetermined distance; and a connection portion connecting the first guide member and the second guide member to be pivotally movable relative to each other on a side of the third side surface;

a gap formed between the first guide member and the second guide member in a region from the connection portion on the side of the third side surface to the first side surface; and a recess indented into a part of the first guide surface of the first guide member and extending from the fourth side surface toward the third side surface, and an end edge of the recess on a side of the first side surface being located at a same position as an end edge of the gap on a side of the second side surface in a sheet conveying direction or on an upstream side in the sheet conveying direction.

4. The image forming apparatus according to claim 3, wherein the sheet receiving device is a post processing device having a sheet receiving port formed therein for performing a predetermined post process to the sheet received through the sheet receiving port, and the sheet conveying device is configured to receive and convey the sheet into the entrance port through the sheet discharge port, and to feed the sheet into the sheet receiving port through the exit port.

5. The image forming apparatus according to claim 3, wherein the sheet conveying device conveys the sheet in a horizontal direction, the first guide member is a lower guide member configured such that the first guide surface constitutes a lower guide surface of the sheet conveying path, and the second guide member is an upper guide member configured such that the second guide surface constitutes an upper guide surface of the sheet conveying path.

6. The image forming apparatus according to claim 5, wherein the upper guide member is pivotally movable with respect to the lower guide member around the connection portion in a state that the sheet conveying device is mounted in the internal sheet discharge portion for opening the sheet conveying path to such a degree until an upper surface of the upper guide member on a side of the fourth side surface interferes with a top surface of the internal space.

7. The image forming apparatus according to claim 3, further comprising:

a fixing member that provisionally fixes the sheet conveying device to the apparatus body in a state that the sheet conveying device is mounted in the internal sheet discharge portion.

8. The image forming apparatus according to claim 3, further comprising:

an illumination member that illuminates a space of the internal sheet discharge portion, wherein at least one of the first guide member and the second guide member is formed of a transparent member.

* * * * *